US009663329B2

(12) United States Patent
Zappa

(10) Patent No.: US 9,663,329 B2
(45) Date of Patent: May 30, 2017

(54) LIFT CAGES WITH IMPROVED BLOCKING/RELEASING DEVICES

(75) Inventor: Roberto Zappa, Bergamo (IT)

(73) Assignee: SEMATIC S.P.A., Osio Sotto (BG) (IT)

( * ) Notice: Subject to any disclaimer, the term of this patent is extended or adjusted under 35 U.S.C. 154(b) by 0 days.

(21) Appl. No.: 14/408,569

(22) PCT Filed: Jun. 18, 2012

(86) PCT No.: PCT/IT2012/000184
§ 371 (c)(1),
(2), (4) Date: Feb. 13, 2015

(87) PCT Pub. No.: WO2013/190578
PCT Pub. Date: Dec. 27, 2013

(65) Prior Publication Data

US 2015/0203329 A1 Jul. 23, 2015

(51) Int. Cl.
*B66B 13/12* (2006.01)
*B66B 11/02* (2006.01)

(52) U.S. Cl.
CPC ..... *B66B 13/12* (2013.01); *B66B 11/02* (2013.01); *B66B 13/125* (2013.01)

(58) Field of Classification Search
CPC ..... B66B 13/12; B66B 13/125; B66B 11/02
USPC ..... 187/319
See application file for complete search history.

(56) References Cited

U.S. PATENT DOCUMENTS 2,996,152 A * 8/1961 Olexson ..... B66B 13/12 187/319
3,783,977 A * 1/1974 Voser ..... B66B 13/12 187/319
4,015,688 A * 4/1977 Mangel ..... B66B 13/12 187/319
4,947,964 A * 8/1990 Husmann ..... B66B 13/12 187/314
5,246,089 A * 9/1993 Husmann ..... B66B 13/12 187/319
5,651,428 A * 7/1997 Ahigian ..... B66B 13/12 187/330
5,690,188 A * 11/1997 Takakusaki ..... B66B 13/12 187/319

(Continued)

FOREIGN PATENT DOCUMENTS

CN 1522947 A 8/2004
CN 1583538 A 2/2005

(Continued)

*Primary Examiner* — Michael Riegelman
(74) *Attorney, Agent, or Firm* — Robert E. Alderson, Jr.

(57) ABSTRACT

Lift cages are provided which include a crosspiece which houses drive mechanisms, an access aperture and two cage doors which are operatively connected to a first motor element which moves the cage doors from an open position to a closed position. Such cage doors may include a second motor element mechanically and operatively separate from the first motor element, wherein said second motor element is connected to a blocking/releasing carriage of the cage doors. The blocking/releasing carriage may be connected to at least one chute connected to at least one of said cage doors, so as to permit the blocking/releasing of the chutes independently of the actuation of the first motor element and of the cage doors.

12 Claims, 5 Drawing Sheets

(56) References Cited

U.S. PATENT DOCUMENTS

| | | | | |
|---|---|---|---|---|
| 6,328,133 | B1 * | 12/2001 | Kim | B66B 13/12 187/315 |
| 6,340,073 | B1 * | 1/2002 | Lee | B66B 13/20 187/309 |
| 8,820,485 | B2 * | 9/2014 | Umbaugh | B66B 13/16 187/317 |
| 2002/0056594 | A1 * | 5/2002 | Fahl | B66B 13/12 187/316 |
| 2005/0126860 | A1 * | 6/2005 | Rennetaud | B66B 13/12 187/319 |
| 2005/0126861 | A1 * | 6/2005 | Bisang | B66B 13/12 187/319 |
| 2005/0139429 | A1 * | 6/2005 | Bisang | B66B 13/12 187/319 |
| 2006/0107785 | A1 * | 5/2006 | Zappa | B66B 13/20 74/612 |
| 2006/0243535 | A1 * | 11/2006 | Kinoshita | B66B 13/20 187/319 |
| 2007/0227829 | A1 * | 10/2007 | Christen | B66B 13/12 187/319 |
| 2008/0000727 | A1 * | 1/2008 | Dziwak | B66B 13/12 187/319 |
| 2011/0186386 | A1 * | 8/2011 | Gilli | B66B 13/12 187/324 |

FOREIGN PATENT DOCUMENTS

| | | | |
|---|---|---|---|
| CN | 201358115 | Y | 12/2009 |
| DE | 29802281 | U1 | 10/1998 |
| EP | 0839753 | A1 | 5/1998 |
| EP | 1524233 | A1 | 4/2005 |
| EP | 2072449 | A1 | 6/2009 |
| JP | 640685 | A | 2/1994 |

* cited by examiner

LIFT CAGES WITH IMPROVED BLOCKING/RELEASING DEVICES

CROSS-REFERENCE TO RELATED APPLICATION

This application is a National Phase Application of PCT International Application No. PCT/IT2012/000184, International Filing Date, Jun. 18, 2012 which is hereby incorporated by reference in its entirety.

FIELD OF THE INVENTION

The present invention relates to a lift cage door fitted with an improved blocking/releasing device of the mechanisms known as chutes.

In particular, the cages of lifts are fitted with cage doors which permit access to the inner compartment of the cage. The cage doors are in turn coupled to landing doors which permit access to the cage itself. The landing doors are substantially coupled to the cage doors for safety reasons in that they prevent access to the lift shaft when the cage is not present in the shaft, inasmuch as positioned at another floor for example.

When the doors open and close the chutes need to be blocked in an open position to permit coupling with the lock of the landing door. When closing is complete and the panels are in the closed position, the chutes must be released to enable closure.

BACKGROUND OF THE INVENTION

The solutions of the prior art envisage the use of motor means which determine the movement of the doors and also of the blocking/releasing means of the chutes, generally speaking by means of the same transmission belt. In practice, after drawing the doors together to close them the motor means activate the relative blocking/releasing means.

In such a configuration, problems arise in regulating the cage doors: in fact even a slight misalignment of the right side and left side of a door or between the cage door and the corresponding landing door, is sufficient to cause uncomfortable vibrations and movements for the user during the opening and closing movement in proximity of the releasing/blocking area.

Such vibrations, while not constituting a real danger in terms of reliability of the cage, are perceived by users as symptomatic of poor resistance, efficiency and generally poor quality of the cage.

SUMMARY OF THE INVENTION

The purpose of the present invention is to overcome the drawbacks mentioned with reference to the prior art.

Such drawbacks and limitations are resolved by cage doors as described and claimed herein.

Other embodiments of the cage door according to the invention are described in the subsequent claims.

Further characteristics and advantages of the present invention will be described in detail with reference to the annexed figures.

BRIEF DESCRIPTION OF THE FIGURES

The elements or parts of elements common to the embodiments described below will be indicated using the same reference numerals.

DETAILED DESCRIPTION

Figure 1:
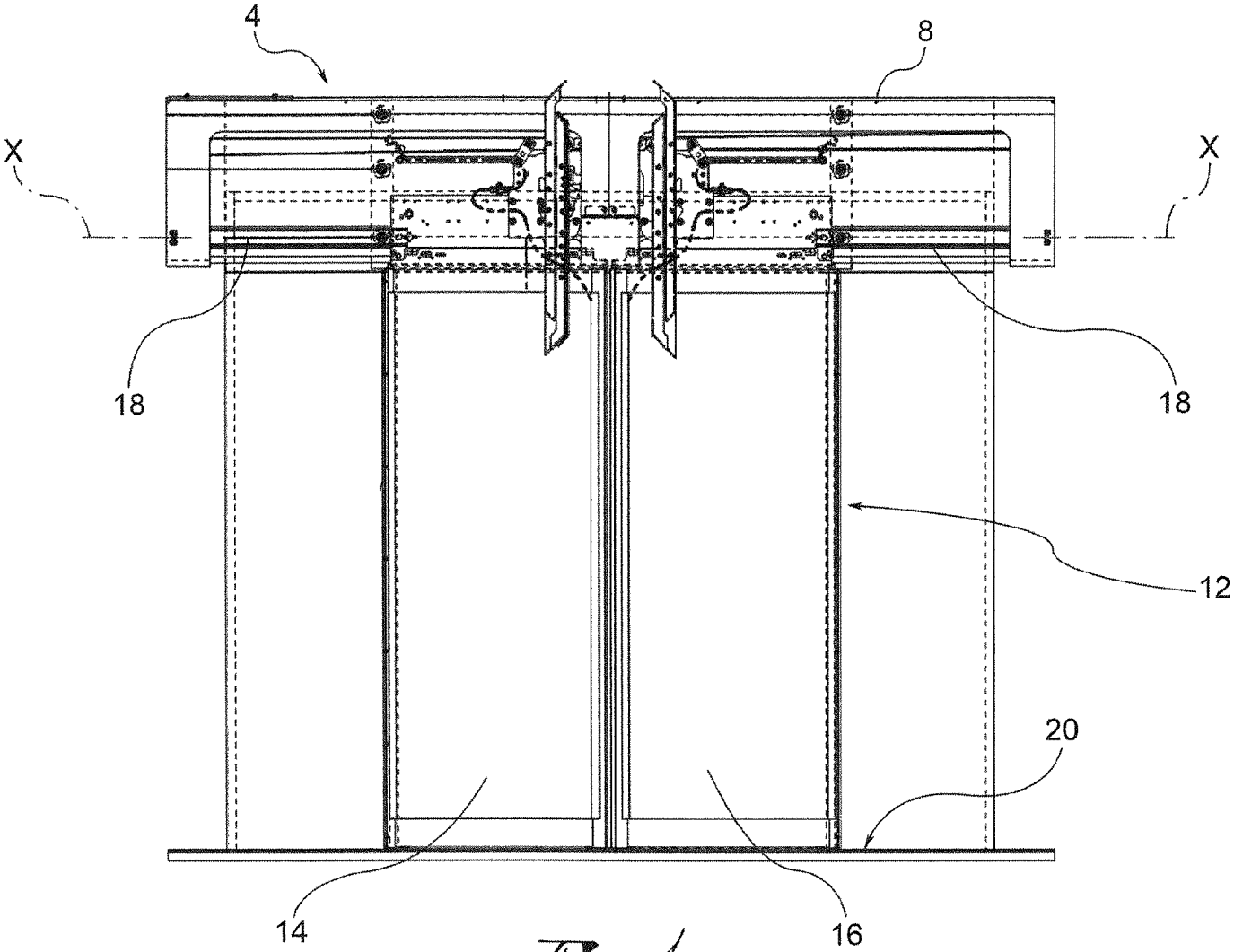
FIG. 1 shows a front view of a lift cage door according to one embodiment of the present invention.
Figure 2:
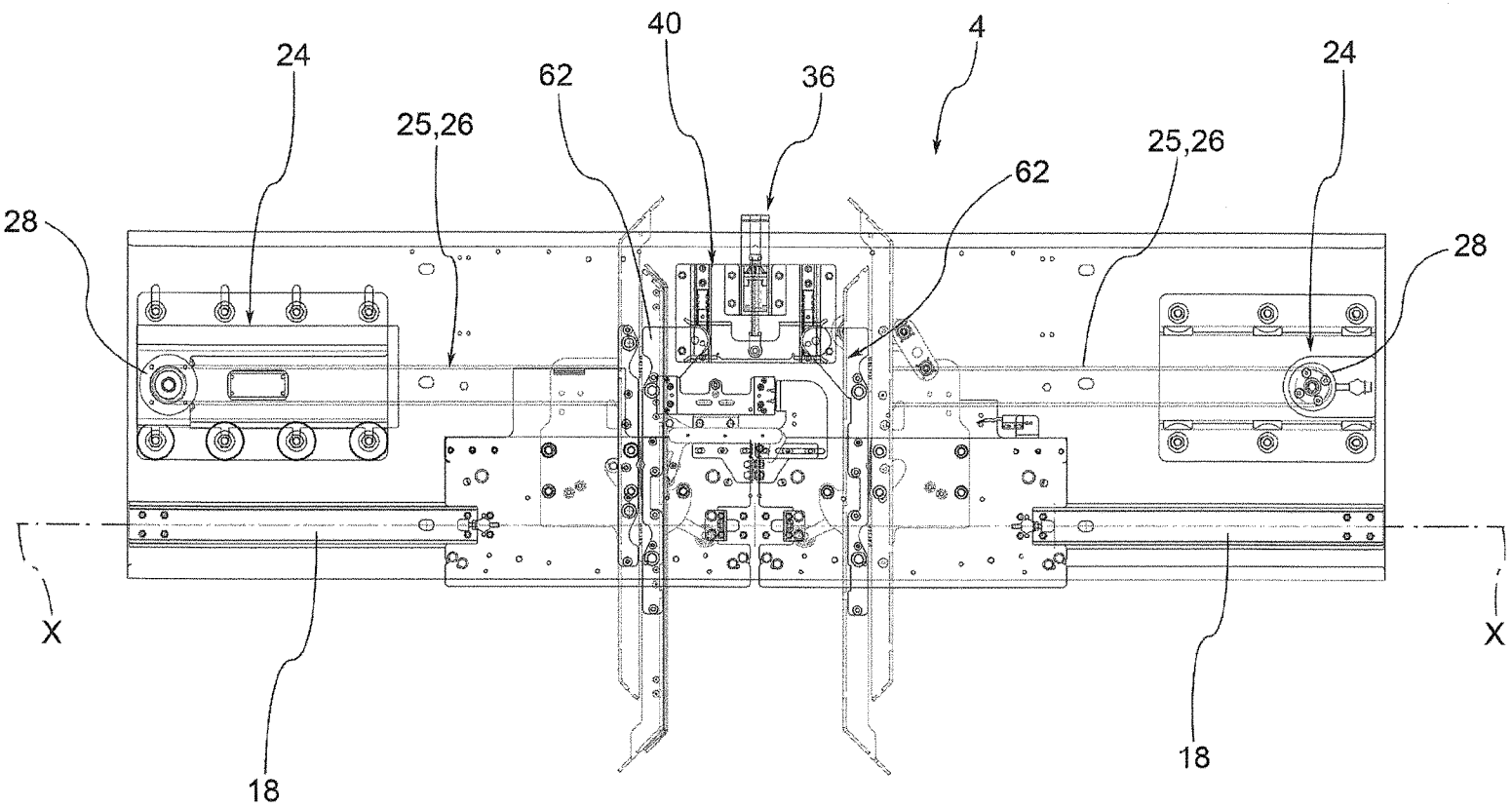
FIG. 2 shows a front view of a further cage for lifts according to the present invention.
Figure 3:
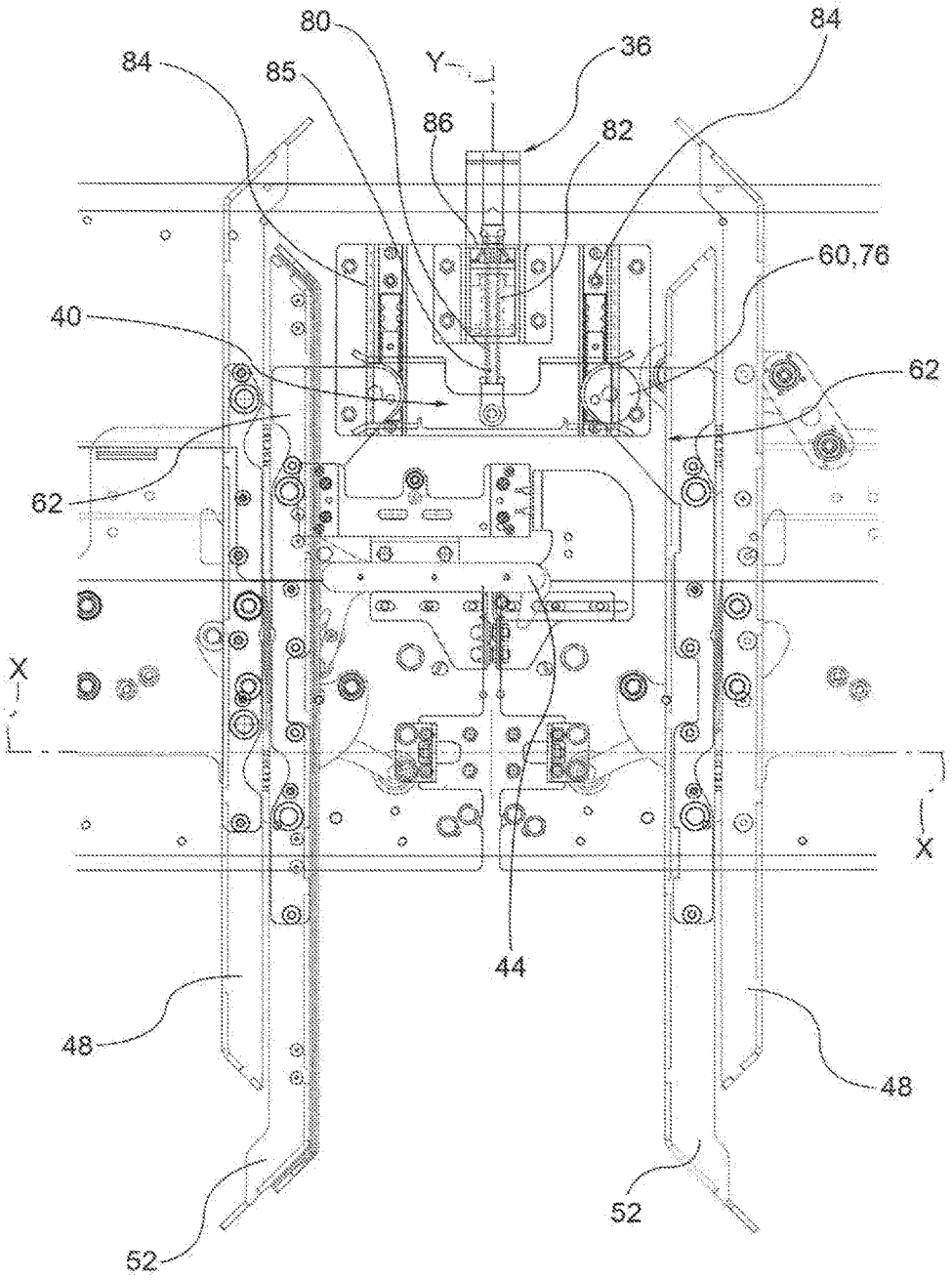
FIG. 3 shows an enlarged view of the detail III in FIG. 2.

With reference to the appended drawings, reference numeral 4 globally denotes a lift cage door, comprising a crosspiece 8 which houses drive mechanisms, an access aperture 12 and two cage doors or panels 14,16.

For the purposes of the present invention the shape and size of the lift cage door is irrelevant, as is the number and type of cage doors.

For example, the cage door 4 may consist of two or more doors or panels 14, 16 opening centrally or of two or more panels 14, 16 opening laterally, known as telescopic. In addition, the panels 14, 16 may be made from metal or may envisage a perimetral outer frame to which a sheet of glass is attached. In general, the panels 14, 16 are mobile in an opening/closing direction X-X typically horizontal, parallel to the corresponding floor surface of the inner compartment of the cage.

According to one possible non-limiting embodiment, the panels 14, 16 are for example fitted to horizontal guides or tracks 18 which permit the opening and closing movement parallel to the corresponding cage floor 20.

The panels 14, 16 are operatively connected to a first motor element 24 which moves the panels 14, 16 from an open position to a closed position and vice versa.

The first motor element 24 is operatively connected to the panels 14, 16 by a first transmission element 25.

For example, said first motor element 24 comprises electric motors, and the first transmission element 25 comprises a transmission belt 26 connected to the panels 14, 16 so as to move them in the opening and closing movements.

For example, the transmission belt 26 engages in respective pulleys 28, causing the movement of the panels 14, 16.

Obviously it is possible to use further types of first motor elements, including hydraulic and/or pneumatically operated motors.

Advantageously, the lift cage door 4 comprises a second motor element 36, mechanically and operatively separate from the first motor element 24, wherein said second motor element 36 is connected to a chute blocking/releasing carriage 40 associated with the cage doors or panels 14, 16.

According to one embodiment, the cage doors 14, 16 are each associated with a chute and said chute is operatively connected to the first motor element 24.

In addition, each chute is provided with two blades 48 and 52 suitable for acting in conjunction with a lock of the landing door to permit its opening and closing.

Such reciprocal hinging makes it possible to draw together and/or distance the blades of the chute 48, 52 from each other to enable the engagement or the release from the landing lock.

According to one embodiment, the blocking/releasing carriage 40 is provided with seats 56 suitable for housing and engaging with actuation elements 60 connected to a support plate 62.

According to one embodiment, said seats 56 are delimited by profiles 64 which receive the actuation elements 60 of the chute device during the step of drawing together and closing the cage panels 14, 16.

Preferably, the profiles 64 delimit an entrance slot 68 to facilitate the insertion of the actuation elements 60 inside said seats.

For example, said entrance slot 68 comprises a folded profile 64 flap 72 so as to constitute a slot for the insertion of the actuation elements 60, said flap 72 tapering towards the inside of the seats 56.

According to one embodiment, the actuation elements 60 comprise wheels 76 which engage in the seats 56 during the closing of the cage panels 14, 16.

Preferably, said seats 56 are laterally open so as to identify access apertures 78 directly facing the actuation elements 60 and suitable for receiving the actuation elements 60 during the closing stroke of the cage panels 14, 16.

Preferably, the blocking/releasing carriage 40 is operated in an actuation direction Y-Y perpendicular to the insertion direction of the actuation elements in the respective seats 56.

Such perpendicularity constitutes a safety element in that it prevents the actuation elements 60 from being released or disengaging from said seats during the movement of the blocking/releasing carriage 40.

In fact thanks to such perpendicularity, during the movement of the blocking/releasing carriage 40, the actuation elements 60 come to abut against the profiles 64 but are not pushed to move parallel to such profiles and thereby come out of the seats.

Preferably, the actuation elements 60 are connected to the chutes and the chute blades 48, 52 by levers 54 operated by the movement of the blocking/releasing carriage 40 so as to permit the blocking/releasing of the chute.

The carriage is moved by the second motor element 36 which, as seen, is mechanically and operatively separate from the first motor element.

The second motor element 36 is operatively connected to the blocking/releasing carriage 40 by a second transmission element 80, which is mechanically separate and independent of the first transmission element 25 which connects the first motor element 24 to the cage panels 14, 16.

According to one embodiment, the second motor element 36 comprises a motor, preferably electric, fitted with a shaft and a pinion. The second transmission element 80 may comprise a rack joined to the blocking/releasing carriage 40, in which the pinion engages with said rack.

According to a further embodiment, the second motor element 36 comprises a motor, preferably electric, fitted with a shaft and a worm 86, said worm engaging with a rack 85 joined to the blocking/releasing carriage 40.

Preferably, the kinematic coupling 82 between the pinion and/or the screw and the rack is of the irreversible type, so as to prevent a movement of the rack or worm from generating a movement of the shaft of the second motor element 36.

In other words, the kinematic coupling of the irreversible type prevents the blocking/releasing carriage from moving and thereby enables the chutes to open under the effect of the forces acting on said carriage. The only way of releasing the blocking/releasing carriage 40 consists therefore of the direct and controlled actuation of the second motor element 36.

The blocking/releasing carriage 40 can be moved in a plurality of directions, preferably guided by at least one carriage guide 84.

According to a preferred embodiment, the blocking/releasing carriage 40 is moved in an actuation direction Y-Y substantially perpendicular to the opening/closing direction X-X of the cage doors 14, 16.

Preferably, the blocking/releasing carriage 40 is moved in a vertical actuation direction Y-Y perpendicular to the opening/closing direction X-X of the cage doors 14, 16, in such a way that the weight force acting on the blocking/releasing carriage constitutes a further safety element against the possible release of the chutes.

The blocking/releasing carriage 40 is guided in its actuation movement along at least one carriage guide 84 which may be for example linear or even curvilinear.

According to one embodiment, the blocking/releasing carriage 40 is guided in its actuation movement along two preferably linear carriage guides 84 positioned symmetrically on opposite sides in relation to the second motor element 36.

The functioning of a lift cage door according to the present invention will now be described.

Figure 4:
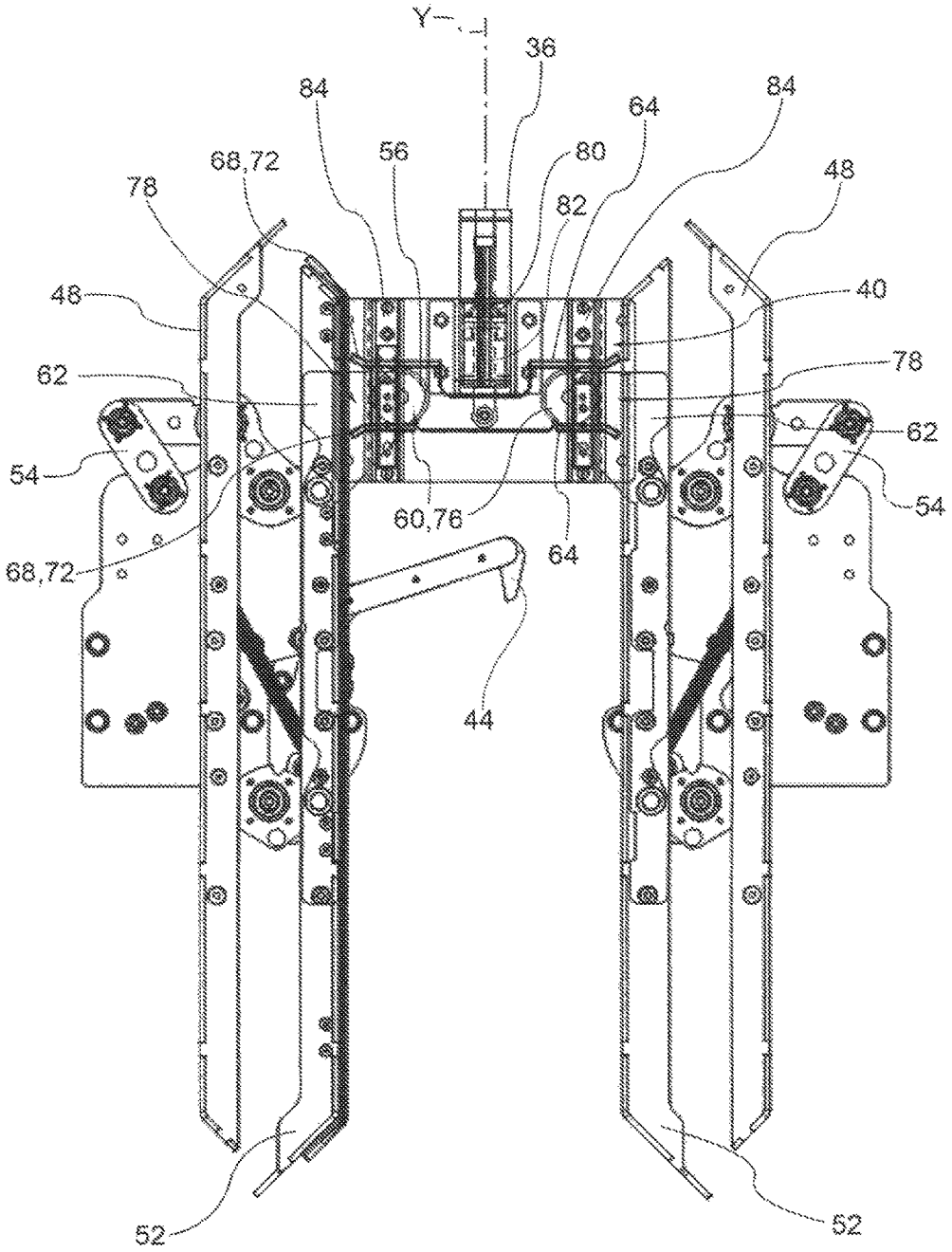
FIG. 4 shows a schematic front view of a portion of the blocking/releasing mechanism of the chutes of a lift cage door according to the present invention, in a blocked configuration with chutes open.

In particular, during the closing phase of the cage doors 14, 16, the first motor element 24 activates the belt bringing the panels into the closed position, as shown for example in FIG. 4. In such configuration the cage doors 14, 16 are closed, that is drawn together to close the access aperture 12, but not yet blocked. In fact, the chutes are still in the open position. Moreover, the blocking/releasing carriage 40 is in the raised position, that is, blocking the chutes.

It is to be noted that in the last phase of the closing stroke of the cage doors 14, 16, the actuation elements 60, that is the wheels 76, are received inside the seats 56 so as to engage with said seats.

The entrance of the wheels 76 inside the seats 56 is facilitated by the presence of the entrance slots 68 mentioned which facilitate the insertion of the wheels preventing possible impact or vibrations.

Consequently, following the closing or drawing together of the cage doors 14, 16 the actuation elements 60 engage in the seats 56: thereby realising a mechanical connection between the blocking/releasing carriage 40 and the chute blades 52.

Figure 5:
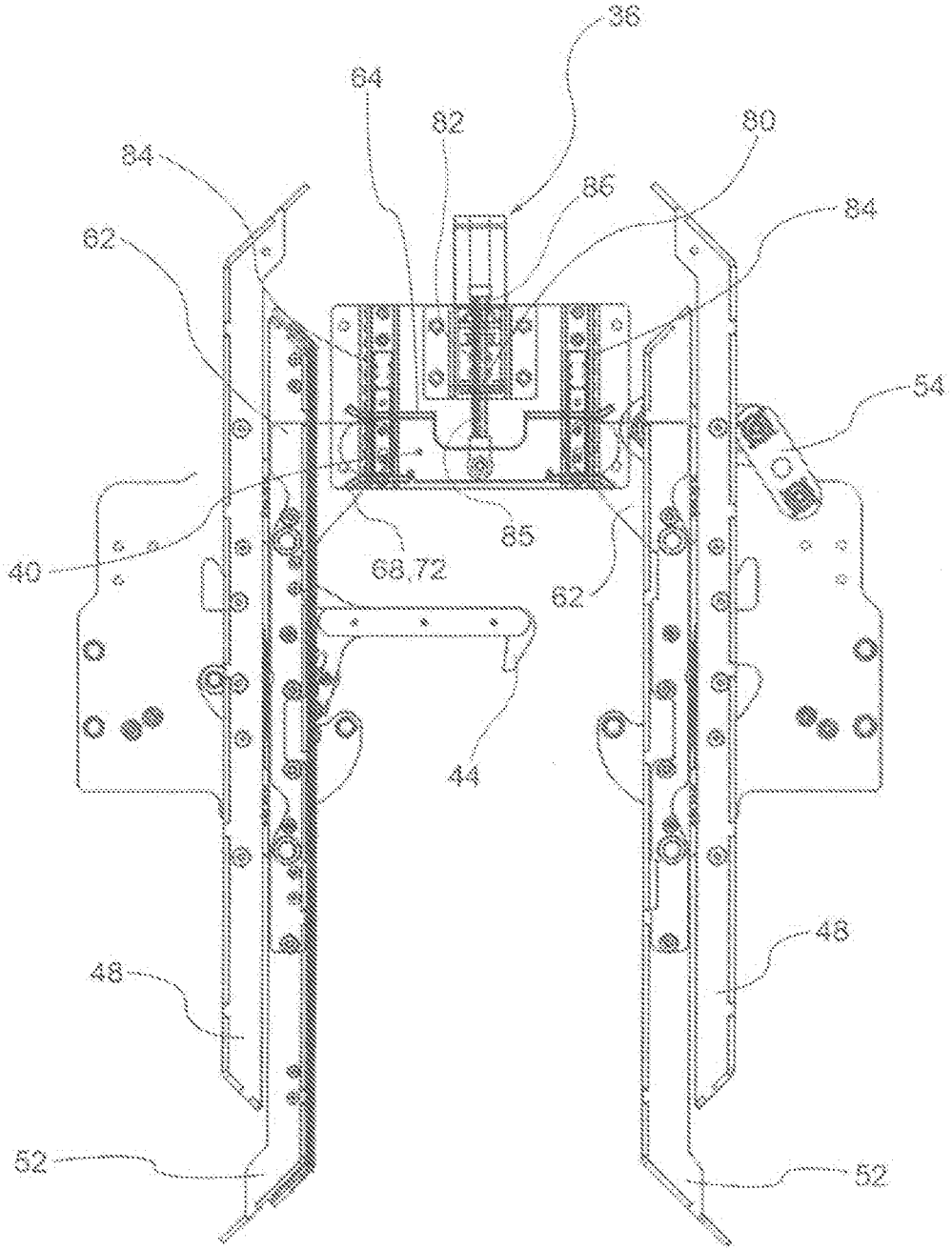
FIG. 5 shows a schematic front view of a portion of the blocking/releasing mechanism of a lift cage door according to the present invention, in a released configuration with chutes closed.

Subsequently (FIG. 5) the second motor element is activated 36 so as to drag the blocking/releasing carriage 40 and, thanks to the actuation elements 60 engaged in the seats 56, so as to also drag the chute blades 52.

The movement of the chute blades 52 is of rototranslation and brings said chute blades 52 to abut against the corresponding blades 48. To perform the subsequent blocking, the blocking/releasing carriage 40 must be moved in the opposite direction so as to raise it and permit the opening, again by means of the levers 54, of the chutes.

After having raised the blocking/releasing carriage 40 it is then possible to actuate the first motor element 24 to open the cage doors 14, 16.

As may be appreciated from the description, the present invention makes it possible to overcome the drawbacks of the prior art presented.

In particular, the lift cage door according to the present invention, thanks to the fact that the motor element of the cage doors and of the blocking/releasing devices is separate and independent of each other, does not present problems of noise and vibrations during the movement of the cage doors, even in proximity of the closing and subsequent opening of the doors.

Advantageously, the absence of vibrations is thereby perceived by users as a greater solidity and reliability of the cage structure itself.

In addition, the absence of vibrations and noise is also ensured in the case of possible slight misalignment of the right side and left side of a landing door or between the landing door and corresponding associated cage door.

The blocking/releasing carriage is extremely safe given that the respective kinematism is of the irreversible type and therefore it is impossible for the chutes to disengage without the prior activation of the second motor element.

In addition, the weight force acting on the blocking/releasing carriage constitutes a further safety element against possible and accidental releasing of the hooking device 44.

A person skilled in the art may make numerous modifications and variations to the cage for lifts described above so as to satisfy contingent and specific requirements, all contained within the sphere of protection of the invention as defined by the appended claims.

The invention claimed is:

1. A lift cage door comprising:

a crosspiece, an access aperture and two cage doors the cage doors being operatively connected to a first motor element which moves the cage doors from an open position to a closed position, and wherein said cage doors are mechanically connected to one or more chutes, wherein the cage comprises a second motor element mechanically and operatively separate from the first motor element, wherein said second motor element is connected to a blocking/releasing carriage of the cage doors, wherein said blocking/releasing carriage is connected to at least one hooking device connected to at least one of said cage doors, so as to permit the blocking/releasing of the one or more chutes independently of the actuation of the first motor element and of the cage doors, wherein the blocking/releasing carriage is provided with seats suitable for housing and engaging with actuation elements of the chute, wherein said seats are delimited by profiles which receive the actuation elements of the chute so that when the cage doors are in the open position the actuation elements are disengaged and are not in contact with the profiles, and when the cage doors are in the closed position said profiles comprise an entrance slot to facilitate the insertion of the actuation elements inside said seats, and wherein the blocking/releasing carriage is provided with an irreversible kinetic coupling to prevent the chutes from disengaging without the prior activation of the second motor element.

2. The lift cage door of claim 1, wherein the first motor element is operatively connected to the cage doors by a first transmission element and the second motor element is operatively connected to the blocking/releasing carriage by a second transmission element, the first and the second transmission elements being mechanically separate and independent of each other.

3. The lift cage door of claim 1, wherein the one or more chutes are connected to the first motor element.

4. The lift cage door of claim 1, wherein said actuation elements comprise wheels which engage in said seats during the closing of the cage doors.

5. The lift cage door of claim 1, wherein said seats are laterally open so as to identify access apertures directly facing the actuation elements and suitable for receiving the actuation elements during a closing stroke of the cage doors.

6. The lift cage door of claim 1, wherein the blocking/releasing carriage moves in an actuation direction perpendicular to an insertion direction of the actuation elements in the respective seats.

7. The lift cage door of claim 1, wherein the blocking/releasing carriage is moved by the second motor element in an actuation direction substantially perpendicular to the opening/closing direction of the cage doors.

8. The lift cage door of claim 1, wherein the blocking/releasing carriage is moved in a vertical actuation direction perpendicular to the opening/closing direction of the cage doors, in such a way that weight force acting on the blocking/releasing carriage constitutes a further safety element to prevent opening of the chutes.

9. The lift cage door of claim 1, wherein the blocking/releasing carriage is configured to move along at least one carriage guide.

10. The lift cage door of claim 1, wherein the carriage is configured to move along two linear carriage guides positioned symmetrically on opposite sides in relation to the second motor element.

11. The lift cage door of claim 1, wherein the second motor element comprises a motor fitted with a shaft and a pinion, said pinion engaging with a rack joined to the blocking/releasing carriage.

12. The lift cage door of claim 1, wherein a kinematic coupling between a pinion and/or a screw and a rack is of the irreversible type, so as to prevent movement of the rack from generating movement of the shaft of the second motor element.

* * * * *